US006244276B1

(12) United States Patent
Henig

(10) Patent No.: US 6,244,276 B1
(45) Date of Patent: Jun. 12, 2001

(54) APPARATUS FOR THE RECOVERY OF DRAGGED-OUT TREATMENT SOLUTIONS BY IMMERSION BARRELS

(76) Inventor: Hans Henig, Albrecht-Achilles-Strasse 48, 90455 Nuremberg (DE)

( * ) Notice: Subject to any disclaimer, the term of this patent is extended or adjusted under 35 U.S.C. 154(b) by 0 days.

(21) Appl. No.: 08/935,474

(22) Filed: Sep. 24, 1997

(30) Foreign Application Priority Data

Sep. 24, 1996 (DE) ..... 196 39 084

(51) Int. Cl.[7] ..... B08B 3/06

(52) U.S. Cl. ..... 134/46; 15/305; 118/63; 118/64; 134/52; 134/61; 134/95.2; 134/102.1; 134/135

(58) Field of Search ..... 134/61, 95.2, 102.1, 134/102.2, 135, 46, 52, 25.4; 15/305; 118/63, 64

(56) References Cited

U.S. PATENT DOCUMENTS

| | | | | |
|---|---|---|---|---|
| 4,317,426 | | 3/1982 | Wheten | 118/418 |
| 4,469,526 | | 9/1984 | Budinsky et al. | 134/25.4 |
| 4,694,527 | * | 9/1987 | Yoshizawa | 134/61 X |
| 5,015,302 | | 5/1991 | Henig | 134/25.4 |
| 5,311,891 | * | 5/1994 | Uchino | 134/61 X |
| 5,421,883 | * | 6/1995 | Bowden | 134/61 X |

FOREIGN PATENT DOCUMENTS

| | | |
|---|---|---|
| 3133629 | 3/1983 | (DE) . |
| 3830237 | 3/1990 | (DE) . |
| 4442160 | 5/1996 | (DE) . |
| 4444103 | 6/1996 | (DE) . |

* cited by examiner

*Primary Examiner*—Philip R. Coe
(74) *Attorney, Agent, or Firm*—Jacobson, Price, Holman & Stern, PLLC

(57) ABSTRACT

Apparatus and a method for the direct recovery of residual quantities of an aqueous solution adhering to pourable mass parts following an electrolytic and/or chemical surface treatment on the parts, in the course of which the parts are carried in a perforated immersion barrel supported on a movable carriage of a barrel treatment installation. A compressed-air chamber is provided on the carriage, into which the barrel is moved, the chamber being provided with a compressed air source to cause a current of air to flow transversely through the chamber. The compressed-air chamber essentially comprises a horizontal, upwardly cylindrically convex upper half-shell which is fixed on the carriage and which encompasses in a substantially air-tight manner the upper half of the immersion barrel when the barrel has been positioned within the chamber, and a pair of horizontal, lateral, lower, outwardly cylindrically convex quarter-shells which are capable of movement towards and away from one another. When moved together, the quarter-shells encompass the lower half of the immersion barrel in a substantially air-tight manner, except that the two quarter-shells leave open a relatively narrow longitudinal slot between their two lowermost long edges. The current of air passes into the chamber and after passing through the barrel and over its contents, leaves the chamber downwardly, entraining any dragged-out solution in the air stream. Water may be injected into the air stream, to assist removal from the parts of the dragged-out solution.

12 Claims, 5 Drawing Sheets

DILUTION RATE 2000 BLOW OPERATION RATIO 50%

| | Drag-Out l/h | Rinsing Water l/h | Salt Load in Drag-Out g/h | Recovery of Drag-Out % |
|---|---|---|---|---|
| Prior Art (without blowing operation, without water injection) | 25·4 | 320 | 2,540 | |
| With blowing operation (without water injection) | 12·7 | 160 | 1,270 | 50 |
| With blowing operation, with water injection | 7·6 | 96 | 760 | 71·08 |

FIG. 5

APPARATUS FOR THE RECOVERY OF DRAGGED-OUT TREATMENT SOLUTIONS BY IMMERSION BARRELS

BACKGROUND TO THE INVENTION

1) Field of the Invention

The invention concerns a method and associated apparatus for the direct recovery, following an electrolytic and/or chemical surface treatment, of residual quantities of an aqueous solution adhering to a charge of pourable mass parts in a movable perforated immersion barrel. The immersion barrel is moved to be positioned in a compressed-air chamber, connected to a centrifugal fan, on a carriage of a barrel installation. A current of air flowing transversely through said chamber entrains the solution residue adhering to the charge into a tank located below the chamber.

2) Description of the Prior Art

Such an apparatus for performing the described above method is known from German Patent Specification DE 31 33 629 C2. The immersion barrel which is attached to the carriage is moved out of the treatment solution tank into a compressed-air chamber and when positioned therein, is subjected together with the contained charge of pourable mass parts to an air current, flowing transversely through the barrel and charge. The air current entrains residual solution adhering to the charge and directs it specifically downwards through a longitudinal slot at the base of the compressed-air chamber, returning it into the tank from which it was previously dragged out.

The known compressed-air chamber consists essentially of two movable half-shells, disposed on the carriage and capable of being displaced towards the raised immersion barrel, so as to enclose the immersion barrel on all sides, apart from a narrow, open longitudinal slot on the underside. The compressed-air chamber is connected to a low-pressure fan which delivers the required quantity of air through the two hollow half-shells. Following completion of the blowing operation, the immersion barrel is moved to the next processing station by means of the carriage, the two movable half-shells are removed sideways from the immersion barrel and the latter is lowered into the tank below, containing the next treatment solution.

The displaceable half-shells are hollow and are provided with openings for blowing the current of air therethrough and, if required, also for the passage of rinsing water.

The known method provides for an unpressurized water rinsing of the charge and the barrel both before the blowing operation for removal of the dragged-out residues of treatment solution, and also simultaneously with the blowing operation.

The quantity of water delivered without pressure has an extremely low process efficiency. Water falling in the form of droplets on the perforated immersion barrel rinses only the exterior of the barrel and runs off the latter without significant wetting of the surfaces of the charge of pourable mass parts contained therein.

The described known apparatus furthermore requires a large amount of apparatus. Control systems must be used for the time-dependent closing and opening cycles of the two half-shells, timed to the raising and lowering operation of the immersion barrel. The half-shells are of considerable dimensions, as appropriate to their function, and are accordingly heavy. The mechanism required for carrying and for simultaneously and synchronously moving the two half-shells on the carriage is costly to produce, complex and difficult to service.

comparable problem and solution can be found in the Published Patent Application DE 44 42 160 A1. Similar movable half-shells execute a circular arc movement, approaching from both sides of the immersion barrel when raised on the carriage, so as closely to enclose it. A fan provides a current of air required for entraining the solution residues, transversely through the barrel and the charge. A lower slot remains open between the two half-shells when moved close together, through which the drawn off residue passes into the tank with the treatment fluid located underneath.

The two movable half-shells are each attached to a swivelling support arm connected to a special mechanism, which necessarily has to be disposed above the motor casing of the barrel unit which is moved into the compressed-air chamber.

The aforementioned design solution obviously results in a substantially greater structural height which is disadvantageous for the erection of the barrel installation.

The cost of the production of the proposed apparatus, however, is not reduced in comparison with that according to German Patent DE 31 33 629 C2. The complicated mechanism, which is not easily accessible, is awkward to service; it is also exposed without protection to the corrosive air within the operating room.

Although German Patent Specification DE 38 30 237 C2 proposes a simplified solution to the problem, which obviously reduces the production costs and facilitates servicing, it has disadvantages of a process nature.

A compressed-air hood mounted on the carriage and connected to a compressed-air supply has essentially the spatial form of an upwardly convex half of a rotational cylinder. The barrel, which is moved into and positioned in the hood, is encompassed by the latter over the circumference of its upper half which is not filled with the charge of pourable mass parts. There is thus created a compressed-air chamber whose base is formed by the air-permeable slope surface of the charge, produced by the rotational movement of the barrel.

The quantity of air blown into the barrel cylinder flows transversely through the mass of the charge and through the perforated lower half of the barrel casing, concomitantly drawing off, to a large degree, the residual quantities of the treatment solution adhering to both of the latter, in order to bring them directly into the tank, located underneath, from which they were previously dragged out.

The current of air emerges from the lower half of the barrel cylinder as a free jet. In terms of fluid mechanics, the polygonal circumference of the lower half of the barrel forms the nozzle outlet of the air jet. Irrespective of its emergence speed, an air jet from a rectangular nozzle has a spread angle of approximately 33°. The conical core of the jet is surrounded by a zone in which the emerging air mixes with the surrounding air with a high degree of vorticity. The total quantity of moved air becomes ever greater, the jet speed ever slower and its range shorter.

It is obvious that, with a higher air speed over the surface of the charge parts and of the barrel cylinder, the achievable effect of drawing off the solution residues adhering to both of the latter and of removing them by means of the air current becomes correspondingly greater.

Accordingly, in the apparatus of Patent DE 38 30 237, the cross-sectional area of the nozzle outlet is approximately equal to the sum of the surfaces of three casing sides. Such an outlet nozzle corresponds approximately to half the circumferential circle of the polygonal barrel cylinder. The air current jet spreads radially from it along the barrel, corresponding to a centre angle of about 180°.

It has been shown that the spreading air jet containing the entrained solution residues goes beyond the edge of the tank into which the dragged-out residues of the treatment solution are to be returned. Particular difficulties occur in the case of bath solutions with high operating temperatures. Additional constructional measures are required to control and locally limit the resultant development of vapour which spreads out in the manner of a cloud.

In summary, it may be stated that, in many cases, the known apparatus and associated methods according to the prior art are not capable, or are capable only to a limited extent, of fulfilling the stringent requirements of operating practice.

OBJECTS OF THE INVENTION

Consequently, the object of this invention is to propose apparatus and an operating method which to a large extent eliminate the disadvantages of the prior art, with the use of simple means. The terms of reference therefore require that the maximum return is directed to the original tank from which the dragged-out residual quantities came, and it is also simultaneously ensured that the magnitude of the current of air is reduced to a sufficient minimum. The apparatus is to be simplified, and reduced in size if at all possible.

SUMMARY OF THE INVENTION

The object is achieved, according to the invention, in that the compressed-air chamber essentially comprises a horizontal, upwardly cylindrically convex upper half-shell which is held against movement in a fixed position on the carriage and encompasses in a substantially air-tight manner the upper half of the immersion barrel when positioned within it, and a pair of horizontal, lateral, lower, outwardly cylindrically convex quarter-shells which are capable of movement towards one another and which, in turn, encompass the lower half of the immersion barrel in a substantially air-tight manner. The two quarter-shells leave open a narrow longitudinal slot between their two lowermost long edges in order to allow the current of air flowing through the compressed-air chamber, and so also transversely through the perforated immersion barrel and through the charge contained therein, to be discharged downwards through the aforementioned open longitudinal slot.

The open longitudinal slot between the two lower ends of the movable quarter-shells according to the invention is located at the base of the compressed-air chamber and is of a width which is substantially smaller than that of one casing side of the polygonal barrel casing. If the barrel cross section is hexagonal, then the centre angle of the slot opening—relative to the longitudinal axis of the immersion barrel—is less than 60°.

The narrow longitudinal slot between the two quarter-shells can be regarded as a rectangular nozzle outlet from the compressed-air chamber. The emerging air jet is directed specifically vertically downwards, i.e., towards the middle of the tank container out of which the immersion barrel has been raised.

The drastically reduced air volume of the narrow jet prevents the current of air from spreading beyond the edges of the tank and additional constructional measures for controlling the movement of air caused by the flow of air out of the compressed-air chamber—one of the principal disadvantages according to the prior art—are no longer necessary.

If a numerical comparison is made with the prior art, represented by the subject-matter of Patent DE 38 30 237 C2, then the advantages of the present invention are obvious.

A hexagonal barrel cylinder with an inside length of 850 mm and an inscribed circle diameter of 330 mm has rectangular, flat casing sides. If it is further assumed that the connected centrifugal fan delivers an air volume of 2200 $m^3/h$ into the compressed-air chamber, then—according to the aforementioned patent—the required mean emergence speed of the air current from the three perforated barrel sides which are not encompassed by the compressed-air hood and which act as nozzle openings is 1.12 m/sec. The emergence angle (centre angle) of the jet, with its vertically downwardly directed core, is 180°.

By contrast, the width of the open longitudinal slot, acting as a nozzle outlet, between the two opposing lower ends of the quarter-shells according to the invention might correspond to a centre angle of 38°. The adequately high air speed through the longitudinal slot is 1.12 m/sec; accordingly, the output of the connected centrifugal fan required for this is equal to 460 $m^3/h$, or 21.1% of the comparative value (of 2200 $m^3/h$, according to the numerical example), or about one fifth of the latter. The dimensions of the fan are accordingly smaller and the volume of the air jet emerging from the compressed-air chamber is likewise reduced to about one fifth.

The central position of the outlet nozzle at the base of the chamber further ensures that the flow of the relatively small volume of air aligned directly towards the middle of the tank remains to a large extent free from secondary interfering turbulences with the moved ambient air.

BRIEF DESCRIPTION OF THE DRAWINGS

In order that the invention may be better understood, it will now be described in greater detail and certain specific embodiments described, referring as appropriate to the accompanying drawings.

In the drawings:

FIG. 5 summarizes in tabular form that which is depicted in FIG. 4.

DESCRIPTION OF THE INVENTION

Figure 1:
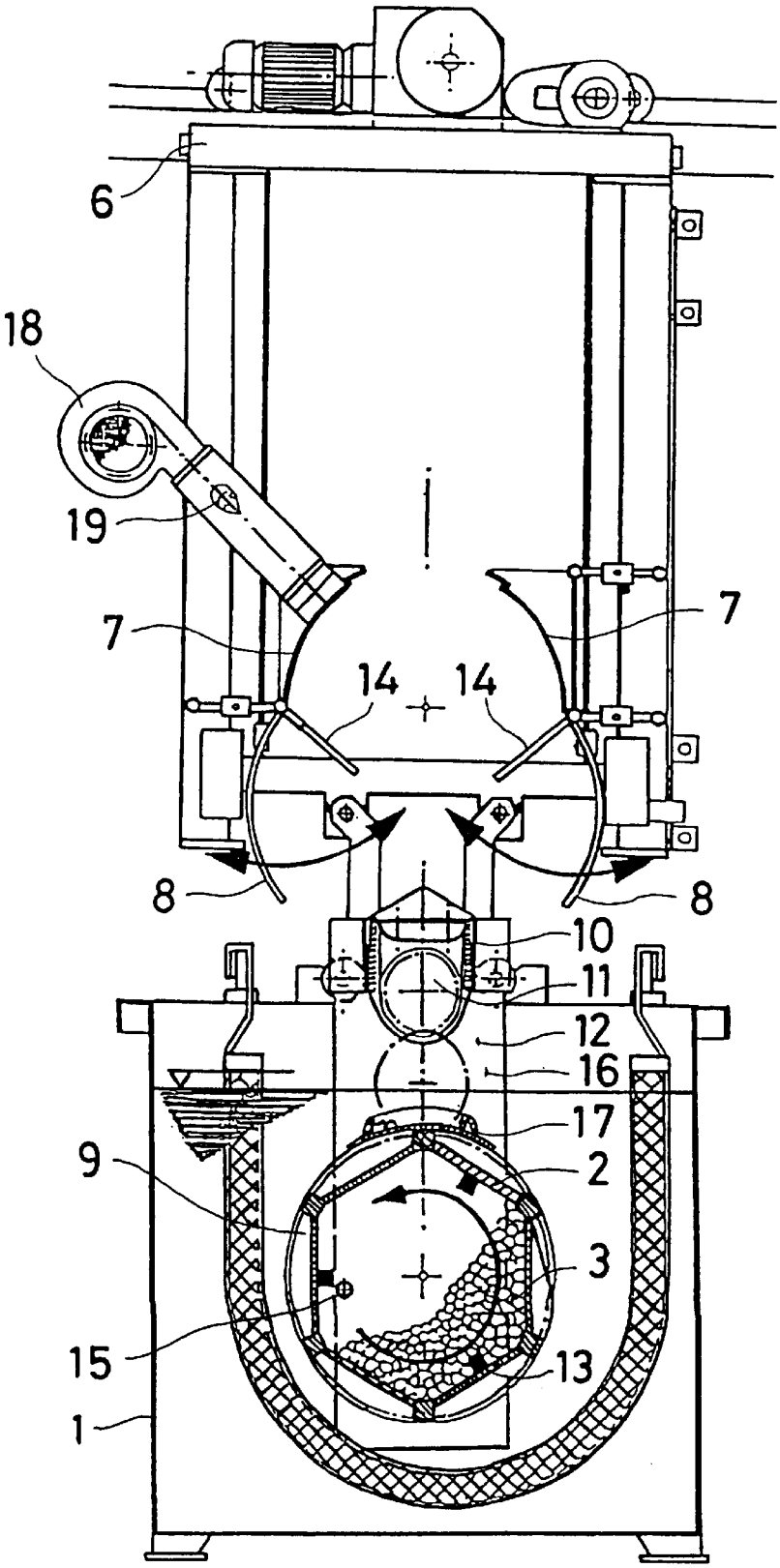
FIG. 1 shows a cross section through a tank containing a bath solution, in which the barrel, together with a charge, is in its immersed operating position, and also the carriage, stopped above it, with an opened compressed-air chamber disposed rigidly thereon.

Apparatus according to the invention has the compressed-air chamber connected to a compressed-air line (usually from a centrifugal fan) and, simultaneously, to a water supply line. The methods according to the invention for the application of the aforementioned apparatus which have as their object the recovery of the dragged-out bath solutions are composed of sequences of combined steps of which the fundamental elements consist of the current of air introduced into the compressed-air chamber and of defined quantities of injected water.

The downwardly directed current of air flows transversely through the compressed-air chamber, and so also transversely through the immersion barrel positioned within it and through the charge contained within the barrel. This performs the function, as a motive driving force and a means of transportation, of intercepting, entraining and drawing off and returning downwards directly into tank located therebelow, the treatment solution in concentrated form, or a mixture of the treatment solution and water; in this way, the greater part of the treatment solution previously dragged out of the treatment tank and adhering to the surfaces of the charge parts and of the barrel can be returned to the tank.

It is advantageous in performing this invention that the barrel completes at least one full rotation during the period during which air is blown through it. The current of air thus flows through all perforated casing sides of the polygonal immersion barrel, i.e., through all the perforations, including the smallest, for example of the order of magnitude of 2 mm or smaller.

As the mass charge which circulates in the immersion barrel during the rotation of the latter slides past the open longitudinal slot between the two quarter-shells, the concentrated current of air flows for a period through the entire barrel peripheral circumference. This ensures that any solution residue adhering to the surfaces of the mass of parts of the charge, including those of a geometrically complex three-dimensional form, is effectively intercepted and removed.

The casing of the barrel, which is of a rotationally symmetrical form, may be fitted with axially parallel, longitudinal tumbling strips on the inside of its perforated wall.

In performing the invention, the immersion barrel is filled with the charge up to about one third of its capacity. Due to the grid-type arrangement of the tumbling strips, the charge mass does not slide along the wall of the rotating barrel, but rotates synchronously with it. The result of this process is that the charge is constantly circulated about its own longitudinal axis about three times per barrel rotation and, consequently, its entire periphery is guided evenly past the nozzle opening between the two quarter-shells. The solution residues on the mass parts are evenly, intensively and rapidly removed.

A higher efficiency attainable by means of the invention is constituted by a substantially increased performance in the recovery of the dragged-out solution residues, within a greatly reduced time span.

The simultaneously reduced air requirement renders possible the use of correspondingly smaller centrifugal fans.

The compressed-air chamber according to the invention is characterised by a compact, space-saving mechanical structure which is easy to service and inexpensive to produce.

The compressed-air chamber includes—as an integral component of the subject-matter of the invention—a compressed-air line connected to a low-pressure centrifugal fan and also includes a water line, connected to an appropriate supply point. The water is optionally injected directly into the air current or into the chamber housing itself, preferably in a saturated mist form, by means of nozzles.

The centrifugal fans can be rigidly mounted in series, for example, on the upper half-shell of the compressed-air chamber.

The injection nozzles, for their part, are generally also attached to the half-shell and disposed as an array parallel to the longitudinal axis of the barrel cylinder.

According to an aspect of the invention, the time-dependent introduction of the current of air and of the injected water into the compressed-air chamber can be effected in various combinations during a holding period during which the immersion barrel is in the compressed-air chamber. During this time, both the air and the water may flow simultaneously, continuously or intermittently into the chamber.

It is advantageous for the predefined volume of water to be injected under pressure directly into the current of air on its path to the barrel cylinder. In this way, the air is used as a means of transport to distribute and cause the injected water, uniformly dispersed, evenly and fully to wet all charge parts present in the immersion barrel.

The apparatus according to the invention is employed, by means of the current of air and injected volume of water guided through the immersion barrel, for the application of some invention-specific methods which are characterised by combinations of different, single or multiple, steps proceeding in defined sequences.

The volume of water injected directly into the current of air or into the compressed-air chamber and transported to the charge and the barrel is quantitatively approximately half of the quantity of solution dragged out of the treatment solution tank by the charge and the barrel.

The aforementioned methods according to the invention are discussed briefly.

The immersion barrel is moved into and positioned in the compressed-air chamber, the lower quarter-shells close and the current of air flows transversely, for a predefined period of time (during a first step), through the perforated barrel cylinder and through the charge within it. A large portion of the residual quantities of the dragged-out treatment solution adhering to the surfaces of the barrel body and of the charge parts is intercepted, entrained in the air flow and drawn off, to be returned into the tank, located below the chamber, from which the solution was previously dragged out.

The obvious advantages of the combined action between the apparatus according to the invention and the associated method can be illustrated by means of a numerical example according to operational practice.

Fifty percent of the dragged-out volume of the bath solution, of 25.4 l/h, is blown into the tank underneath during the holding period of the barrel cylinder in the compressed-air chamber. The prescribed dilution rate is to be equal to 2000.

The rinsing water requirement according to the prior art would be 320 l/h, but the invention reduces this volume to 160 l/h.

Half, i.e., 12.7 l/h, of the bath solutions otherwise carried into the rinsing baths is directly recovered and the rinsing water requirement is also halved accordingly. The consumption of salts for the neutralisation or decontamination installation is reduced in the same proportion; the level of expenditure for waste dumping is reduced accordingly (by reduction of the salt load from 2540 g/h to 1270 g/h).

The immersion barrel positioned in the compressed-air chamber, together with the charge, is continuously traversed by the air current during its predefined holding period and simultaneously sprayed with a defined volume of injected water.

The resultant mixture of treatment solution and water is intercepted by the air current and the greater part of it is brought into the tank with the bath solution located below the chamber.

Metrological studies have shown surprising effects as a consequence of this use, according to the invention, of the apparatus and the associated method.

The volume of the bath solution dragged out into the connected rinsing bath is further reduced to 7.6 l/h and the rinsing water requirement is reduced proportionately to 96 l/h. The salt load dropped to 760 g/h.

Figure 4:
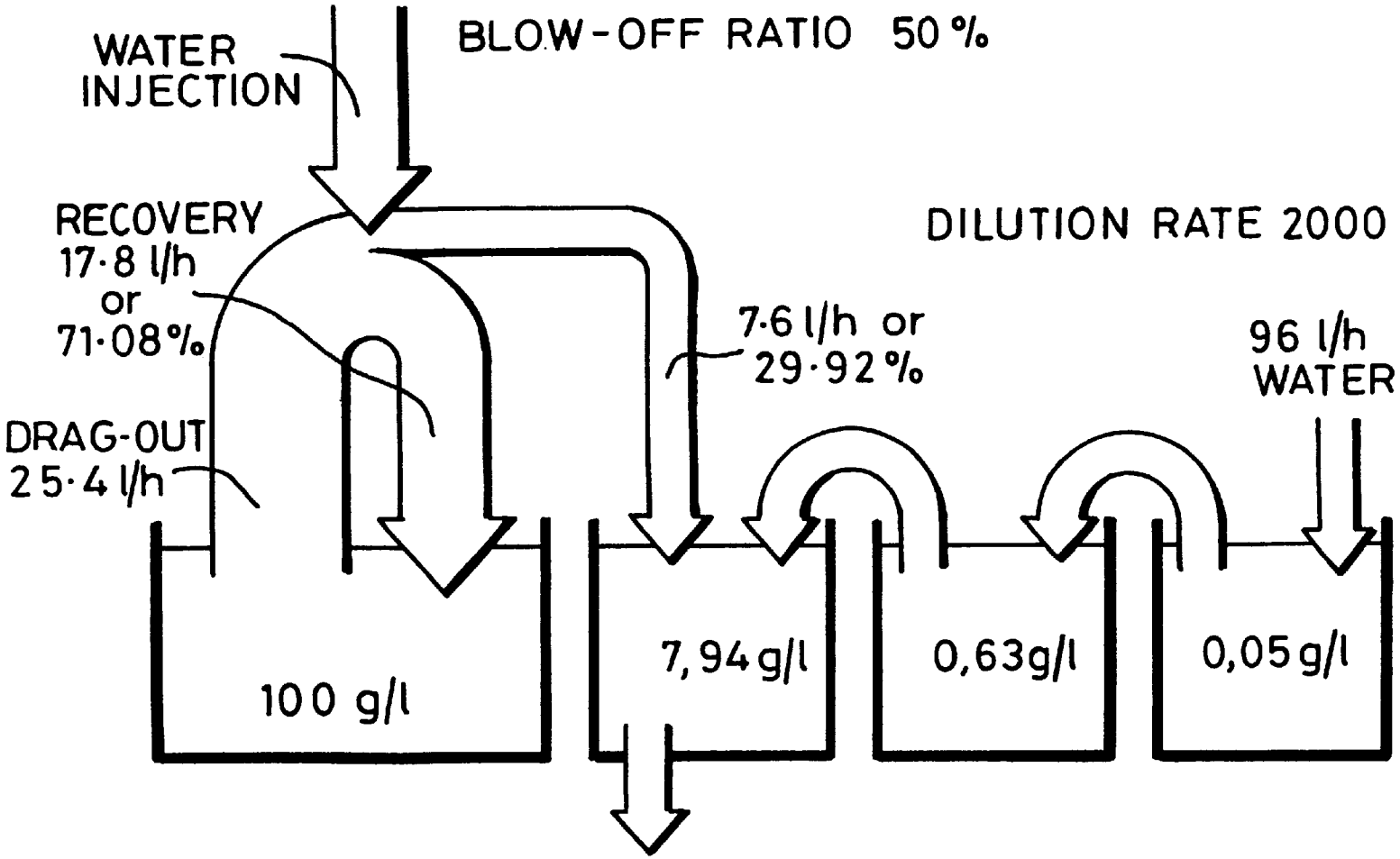
FIG. 4 depicts the functional context of the invention, based on the representations of apparatus of FIGS. 1 to 3. The numerical basis values of the example given, being the dilution rate, the volume of drag-out by the immersion barrel, the ratio blown off by means of the compressed-air chamber, the connected three-stage cascade rinsing and the required quantity of rinsing water, are taken from operational practice as parameters for an application case.

The schematic representation appended as FIG. 4 and the summary table of the determined measurement values, appended as FIG. 5, show that the combined action, according to the invention, of the apparatus and the method renders possible a direct recovery of the dragged-out solution in the proportion of 71.08% as compared with the prior art. The consumption of rinsing water for the maintenance of the rinsing criterion of 2000 is reduced by the same percentage, of approximately 70%, in common with the corresponding salt load.

The injection of the cooling water into the compressed-air chamber has a particular significance with respect to the apparatus. Operational experience has shown that, if the apparatus according to the invention is used, it is possible to save one stage of a multi-stage cascade rinsing.

Experience has also shown, in the application case B, that, if a second step follows immediately—during which no further water is injected into the continuing current of air—the proportion of the treatment solution recovered is further increased by a substantial amount.

During the second step, the immersion barrel expediently executes an additional full rotation.

In another case of application of the invention, the greater part of the dragged-out bath solution on the barrel and the charge is returned in a first step, in a concentrated form, into the original tank by means of the air current in order for a defined volume of water to be injected into the compressed-air chamber in an immediately subsequent second step—this being during a full, additional, second rotation of the barrel.

A mixture of the treatment solution and water is formed, part of which adheres to the surfaces of the immersion barrel and the charge and part of which drains off into the tank underneath. The blowing-off of the adhering fluid residues by the air current proceeds continuously during the second step.

It has further been established, in an operational examination of a perforated immersion barrel of 950 mm in length and an inscribed circle diameter of 360 mm, that 1.2 l of bath solution was dragged out in each case.

The required dilution rate of 1000 was achieved in a two-stage cascade rinsing with 37.9 l of water per immersion barrel.

In the first step, 60% (or 0.72 l) of the drag-out was returned in concentrated form into the original tank by the air current during one full barrel rotation, which was a period of 10 sec.

The subsequent second step likewise lasted for 10 sec., with 1 l of water being injected into the air current during this period.

The blow-off ratio remained unchanged at 60%; a measured quantity of 1.48 l of the resultant mixture (with a proportion of 0.32 l of concentrate) was additionally returned into the tank with the bath solution.

The sum of 0.72 l and 0.32 l gives the total quantity of 1.04 l of the recovered drag-out, i.e., 86.7% of the latter.

The quantity of rinsing water required to meet the dilution rate of 1000 was 4.7 l (by contrast with the water requirement of 37.9 l according to the prior art).

Various treatment solutions, for example soak cleaning or phosphatizing baths, have relatively high operating temperatures which range in the order of magnitude of 75° C. and above.

In practical testing of the invention, it has been shown that wet steam can be produced when air is passed through the immersion barrel and charge, heated to a high temperature and wetted with the bath solution, in the compressed-air chamber. The saturated, warm mixture of fluid and air may spread out locally in the form of a cloud and be precipitated as a condensate on the adjacent apparatus, at room temperature.

The consequence is corrosive damage on the metal components of the adjacent apparatus.

The invention provides for a two-step method in this application case.

The barrel cylinder positioned and rotating within the compressed-air chamber, together with the charge, is sprayed for the duration of a first step with a defined volume of water, the current of air remaining switched off. In the subsequent second step, a further predefined volume of rinsing water is injected to the continuously rotating barrel and charge, this time with a simultaneous air current through the compressed-air chamber.

The purpose of the method is the reduction of the temperature both on the dragged-out losses adhering to the charge in the barrel, and on the barrel body itself.

The process can be illustrated—in approximately commercial scale—by the example of an application case adapted to operational practice.

It is to be assumed that the dragged-out quantity of solution, of 2 l, originates from a soak cleaning bath whose operating temperature is 65° C. The temperature of the injected water quantity, of 1 l, might amount to 10° C.

The mixture, of 3 l, resulting from 2 l of treatment solution and 1 l of water, has a mean temperature of 47° C. following completion of the first step; following the addition of a further quantity of 1 l of water during a second step, this falls to only 37.5° C.

The vaporization point of such a reduced-temperature mixture is to be characterised as low; visual perception of vaporization of the blown-off drag-out residues is scarcely possible.

Furthermore, baths with high operating temperatures have high evaporation losses. The quantities of water injected into the compressed-air chamber essentially compensate the fluid losses and the bath volumes thus remain virtually constant.

Consequently, the sequence of recovery in the application case E can proceed under optimum conditions, without being subjected to the adverse effects according to the prior art.

A further variant according to the invention renders possible a drastic and sudden reduction of the temperature of both the dragged-out solution quantities and the immersion barrel itself.

The method according to this variant of the invention consists of a sequence of three connected steps.

In the first step, the non-rotating immersion barrel is raised out of the treatment solution and positioned in the compressed-air chamber. The two lower quarter-shells close. The only remaining possibility by which the vapour of the hot solution can be discharged out of the chamber is through the narrow, open longitudinal slot between the two quarter-shells, at the base of the compressed-air chamber.

The carriage then transports the immersion barrel over a tank which directly adjoins the tank with the hot treatment solution and contains the same solution, with the difference that its bath solution is at room temperature, i.e. a maximum of 20° C.

During a second step, the barrel cylinder, together with the charge, is lowered into and immersed in the lower temperature solution and assumes this temperature within a very short period.

After a short period, the immersion barrel is raised out of the lower temperature bath solution and, in a third step, is moved into and positioned in the compressed-air chamber and the solution residues adhering to the barrel body and to the charge are brought into the tank with the bath solution underneath by means of the applied air current, perhaps with the addition of injected water.

The method according to this variant of the invention fully precludes the otherwise occurring problem of scarcely controllable cloud-like propagations of vaporized bath solution during its recovery by means of an air current emerging from the compressed-air chamber. The method effects a sudden drop in the temperature of the solution residues adhering to the barrel and on the barrel itself, down to the range of the room temperature, i.e. about 20° C.

Operational experience with the known compressed-air chambers has shown that hardened layers of different bath salts come to be formed on their inner wall surfaces. The necessary regular cleaning of the inner walls presents considerable difficulties, particularly due to the rigid disposition of such chambers on the carriages.

The invention offers the possibility of thoroughly rinsing the inner wall surface of the compressed-air chamber by a combined action of the air current and the injection of water into the compressed-air chamber and of thus washing off and removing the salts in a not yet solid, i.e., liquid, state.

In the immersion process, the barrel cylinder and charge are first cleaned with water in a rinsing tank, to remove the still adhering solution residues (following a prior blowing operation to remove the concentrated dragged-off solution) and only then moved into and positioned in the compressed-air chamber of the carriage.

For a predefined period of time, the rotating immersion barrel is exposed, above the rinsing bath, to the current of air flowing through it and is simultaneously sprayed intensively with water. The layer of liquid bath salts on the inner wall of the chamber is to a large extent washed out and the concentration of the remaining film can be characterised as negligibly small.

The upper, immovable and upwardly convex half-shell of the compressed-air chamber attached to the carriage has at its apex an open longitudinal slot for the through—passage of a supporting beam of the barrel unit, so as to render possible its vertical upward and downward movement. Said beam carries, in general, a drive motor mounted on it for rotation of the barrel and an enveloping housing for the purpose of protecting the beam from dragged-off solutions draining from crossing barrel units.

Progressive designs for the frame of barrel units (for example, according to the German Published Patent Application DE 44 44 103 A1) dispose said drive motor laterally, i.e. outside the range of the quadrangular tank with the bath solution, and thus enable the longitudinal slot on the apex of the upper half-shell to be of very small dimensions.

The very compactly dimensioned longitudinal slot simplifies and reduces the size of the generally plate-like displaceable or pivotal sealing elements on the barrel unit or on the half-shell which are necessary in order to close the slot opening following positioning of the barrel in the compressed-air chamber.

The closing and opening of the compressed-air chamber by means of the two lower hinged quarter-shells is effected by the vertical upward and downward movement of the barrel unit, to provide the drive force and control element.

Such a closing and opening mechanism for the actuation of the quarter-shells can consist of a system of coupled lever arms, of which some of the elements are disposed on the compressed-air chamber and some on the barrel unit.

A delivery volume of 1000 $m^3/h$ of air, at a pressure of 0.3 bar, is stated as an example of the required output of one or more low-pressure centrifugal fans connected together as a group for a barrel of approximately 950 mm in length and an inscribed circle diameter of 360 mm.

The pressure for the generation of a water jet sprayed into the compressed-air chamber by means of the injection nozzles might correspond, preferably, to the pressure of the water line (mains pressure) of, generally, 3 to 4 bar, in individual cases, however, this can be reduced by pressure reducing valves to approximately 0.5 bar.

The barrel cylinder rotates continuously or intermittently during its holding period in the compressed-air chamber, irrespective of whether a blowing operation is being performed, or not.

In order that the invention may be better understood, it will now be described in greater detail and certain specific embodiments described, referring as appropriate to the accompanying drawings.

Figure 2:
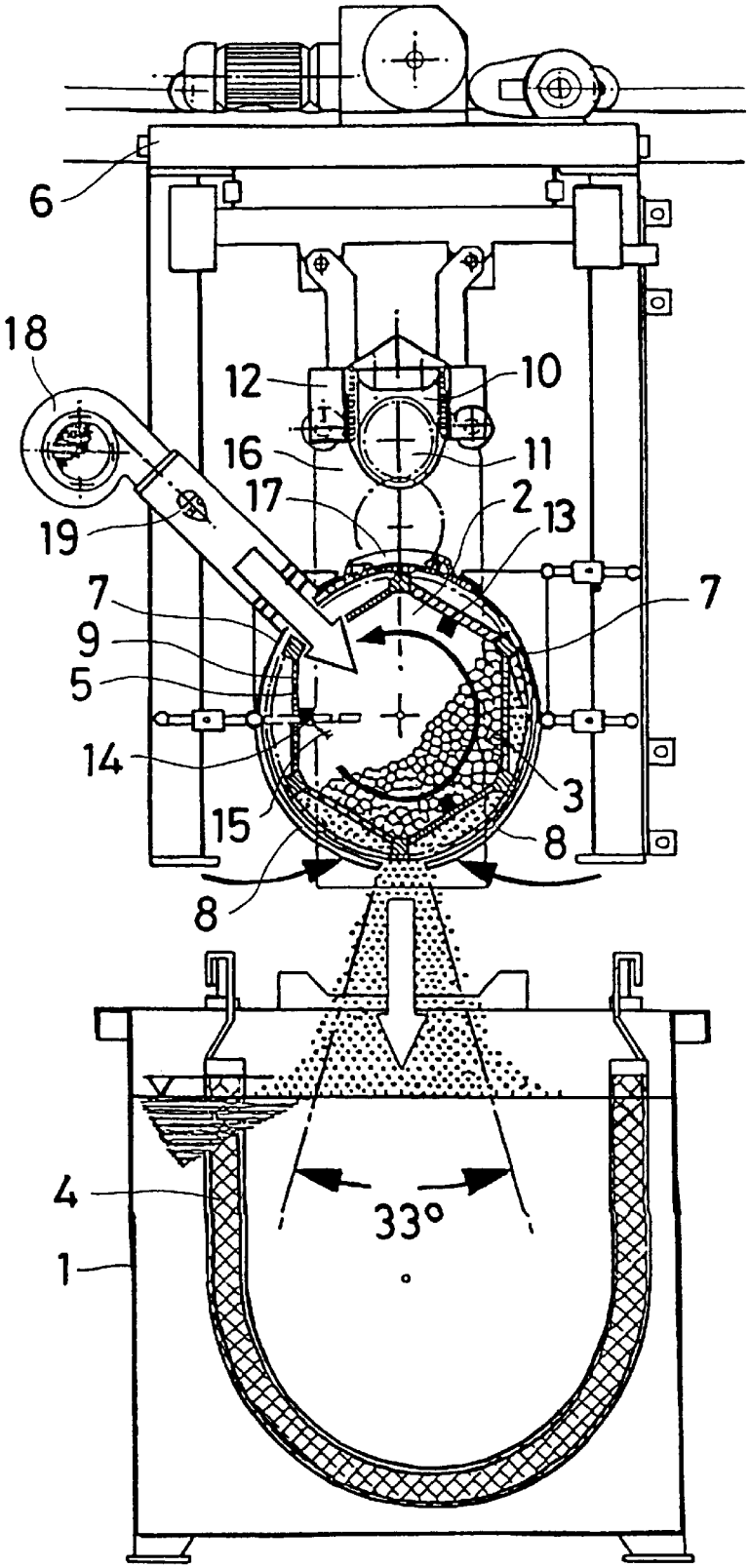
FIG. 2 depicts the first step, according to the invention, of the immersion barrel positioned in the closed compressed-air chamber. The air current flowing transversely through the barrel and the charge brings the greater part of the residual quantities of the electrolyte drag-out adhering to the barrel and charge, in concentrated form, into the tank from which they were previously dragged out.
Figure 3:
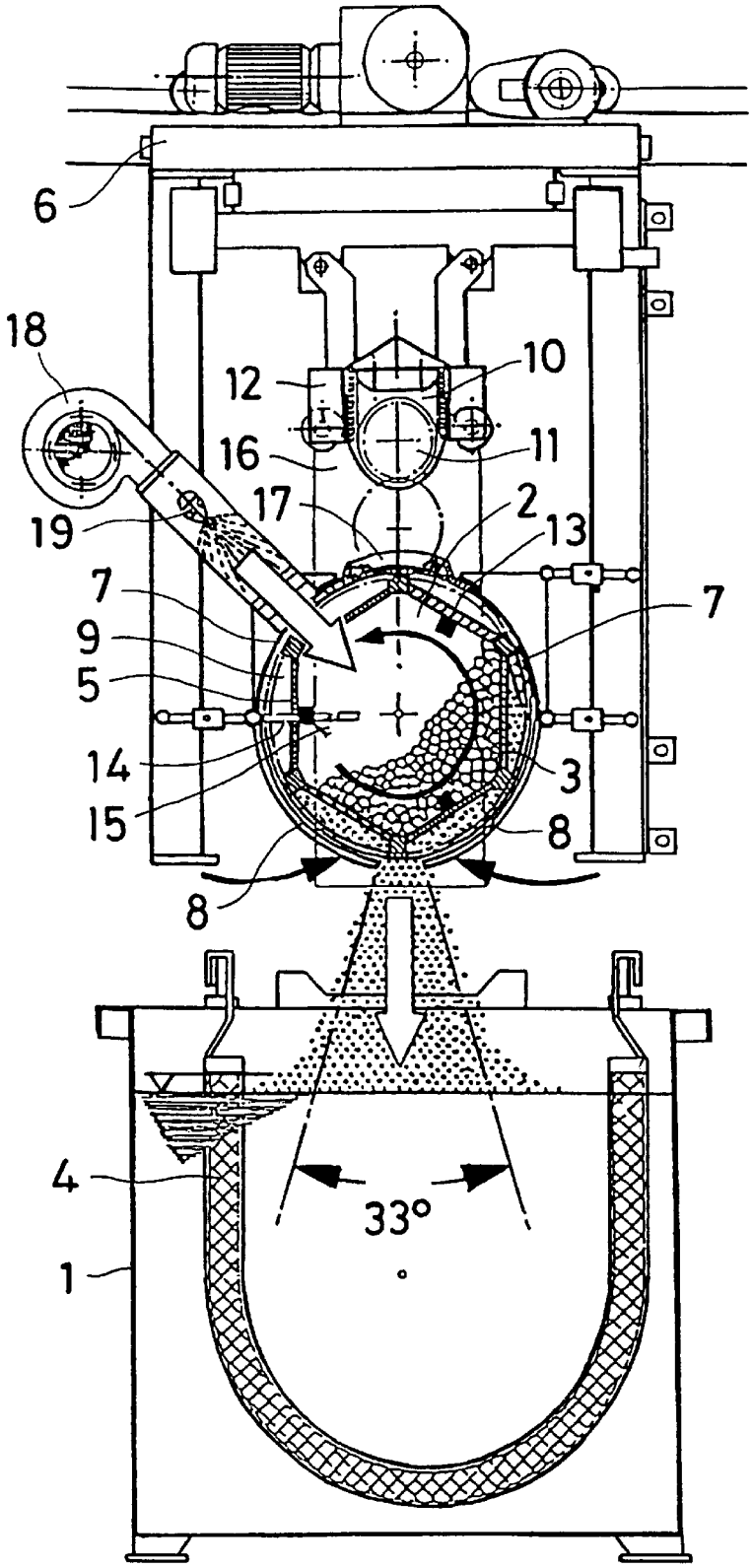
FIG. 3 depicts the operation of the subsequent second step, and shows the injection into the air current of a predefined quantity of water. The air flowing through the barrel and the charge serves as a transport means for the purpose of wetting the immersion barrel and the charge with water and, simultaneously, for the delivery of part of the resultant mixture of treatment solution and water into the tank therebelow.

The particular arrangement of the embodiment of apparatus shown in the drawings will now be described. Referring to FIGS. 1 to 3, tank 1 contains the treatment solution. A cylindrical immersion barrel 2, together with a charge 3, assumes its operating position within the horseshoe-shaped anode basket 4 made from titanium with soluble metal cubes. The hexagonal immersion barrel 2 has a perforated casing 5 made from a synthetic, electrically non-conductive material.

The carriage 6 of the automatic transport mechanism of the barrel installation stops above the tank 1; its compressed-air chamber, which is rigidly disposed thereon, is open.

Said chamber on the carriage 6 consists essentially of an upper fixed upwardly convex half-shell 7 which encompasses the upper half of the barrel 2 when moved into it, and of two likewise outwardly convex hinged quarter-shells 8 which, in turn, closely encompass the lower half of the barrel 2 in an airtight manner.

During the holding period of the barrel 2 positioned in the chamber, its circular end faces 9 form the two lateral end walls of the compressed-air chamber.

The hexagonal barrel 2, together with a drive motor 11 therefor, are mounted on the supporting frame 10, to form a barrel unit 12. The latter is transported from one treatment station of the barrel installation to the next by means of the carriage 6, according to a predefined programme.

The inside of the barrel casing 5 is provided with a grid of tumbling strips 13 for the purpose of preventing the charge 3 from sliding over the barrel surface, and to ensure the synchronous rotation of the barrel 2 and the charge 3 within it.

Each of the two quarter-shells 8 has a respective lever arm 14 which, upon the upward movement of the barrel unit 12, are driven upwards by two short connection pieces 15 mounted on the barrel supporting arms 16 and assigned to each lever arm 14, thereby to force the quarter-shells to turn through approximately 45° about their pivotal axes provided on the lower longitudinal edges of the half-shell. The barrel cylinder 2 is moved into and positioned in the compressed-air chamber, and the two quarter-shells 8 close the latter, apart from a narrow longitudinal slot between their two lower ends running parallel to the longitudinal axis of the immersion barrel 2.

In the reverse process, i.e., upon the downward movement of the barrel unit 12, the two quarter-shells 8 pivot downwards unassisted, due to their own weight.

In the course of its vertical movement, upwards and downwards, the supporting frame 10 of the barrel unit 12 has to slide through the upper half-shell 7. The open longitudinal slot required for this purpose is provided at the apex of the shell 7. When the barrel 2 assumes its operating position within the compressed-air chamber, the said longitudinal slot is sealed in an air-tight manner by a longitudinal plate-type segment 17 disposed horizontally and centrally above the barrel 2. The sealing segment 17 is rigidly fixed between the two perpendicular supporting arms of the barrel unit.

Thus, with the exception of the open longitudinal slot at its base, the compressed-air chamber encompasses, it in an all-round air-tight manner, the rotationally symmetrical barrel 2 positioned within it.

A centrifugal fan 18 is connected, or a number of smaller such fans 18 are connected, via suitable ducts, to the compressed-air chamber, or, perhaps, are mounted directly on the half-shell 7.

The current of air from the fan 18 (indicated by direction arrows in FIGS. 2 and 3) penetrates the charge-free interior space of the immersion barrel 2 and is distributed evenly over the slope surface of the charge 3. Consequently, the preferred position of the or each fan 18 is on one of the two sides of the half-shell 7.

A set of injection nozzles 19 directed towards the compressed-air chamber is disposed so that the injected quantity of water reaches the immersion barrel 2, with the charge 3 within it, in the current of air coming from the fan 18.

The injection nozzles 19 are mostly located on the half-shell 7 of the compressed-air chamber and are controlled by solenoid valves.

The injected quantity of water should correspond to approximately half of the dragged-out electrolyte, and may be at room temperature. The injection period, in particular, for a pressure of about 3 bar, allows for the duration of a full barrel rotation, i.e. about 8 sec. The spray is evenly distributed over the full cone of the injected water jet, which consists of very fine drops (corresponding to a spectrum of 150 to 450 mm).

The air flowing over and past the surface of the charge 3 of parts draws with it, in a first step, the greater part of the bath solution residues adhering to the parts.

The arrows in FIGS. 2 and 3 which point from the barrel cylinder 2 towards the tank 1 indicate the path of the dragged-out solutions recovered in a concentrated form or as a mixture of bath solution and water.

FIG. 3 depicts the second process step, which is characterised by the injection of a defined quantity of water (about 1 l) by means of the nozzle set 19 into the air flowing continuously through the compressed-air chamber following completion of the first step.

The air, saturated with the atomized quantity of water, passes over and beyond the charge 3 of parts and coats them with a thin layer of water which immediately mixes with the residues of the concentrated bath solution remaining on them. The greater part of the resultant mixture is drawn off by the air current, removed from the barrel 2 and transported into the treatment solution tank 1 located therebelow.

The air current jet emerging through the long slot at the base of the compressed-air chamber and containing a mixture of bath solution and water is directed vertically downwards and has an emergence angle of about 33°.

FIG. 4 represents schematically a method according to the invention, based on an application example of the associated apparatus according to FIGS. 1, 2 and 3.

The treatment solution might have a salt concentration of 100 g/l. The required dilution rate is to be 2000, rinsing being effected in a three-stage cascade rinsing operation. The volume of solution dragged-out by the barrel 2 is 25.4 l/h.

The blow-off ratio, i.e., the percentage of the dragged-out solution quantity recovered by means of the air current through the compressed-air chamber, is approximately 50%.

The blow-off operation proceeds in two steps; in a first step, 50% of the dragged-out bath solution is recovered in a concentrated form, and the same percentage in a second, subsequent step—with the addition of water atomized by means of nozzles—but this time as a mixture of treatment solution and water.

The measurements taken in this actual case have shown that it was possible for a total of 17.8 l/h, or 71.08%, of the dragged-out bath solution to be directly recovered, and only 7.5 l/h, or 28.92%, of this was introduced into the first stage of the cascade rinsing.

The volume of water required to meet the dilution rate of 2000 was 96 l/h. The concentration of the bath solution in the first stage of the cascade rinsing gave a measurement value of 7.94 g/l, 0.72 g/l in the second stage and 0.05 g/l in the third stage (or the equivalent of the dilution rate of 2000).

FIG. 5 supplements and summarizes in tabular form the schematic representation from FIG. 4, in comparison with the known prior art.

With the use of a three-stage cascade rinsing and a bath solution drag-out of 25.4 l/h, a volume of 320 l/h of water would be required to meet the criterion of 2000. The corresponding salt load of the drag-out—according to the prior art—would be 2540 g/h.

If the barrel is positioned in the compressed-air chamber according to the invention and if the blow-off ratio is set at 50%, then half of the drag-out, i.e., 12.7 l/h, is returned directly into the treatment solution tank The rinsing water requirement is reduced proportionately, to 160 l/h, the salt load falling to 1270 g/h.

If the effect of water injection according to the invention is added to the recovery process, for example the injection of 12 l/h, then 17.8 l/h, or 71.08%, of the dragged-out bath solution is directly recovered. The quantity of rinsing water required falls, in the same proportion, to 96 l/h and the salt load of the remaining drag-out is reduced to 760 g/h. The preceding example of operational practice shows that the invention is capable of adequately replacing a three-stage cascade rinsing by a two-stage cascade rinsing.

The process principle of a three-stage rinsing also continues to exist within the context of the invention; the first rinsing stage is executed by the injection of water into the air current within the compressed-air chamber containing barrel 2 with its charge 3, the two others following in the related two-stage cascade rinsing.

The direct injection of the rinsing water into the air current saves a complete rinsing process stage. The simultaneous injection and blowing-off of the resultant mixture on the barrel 2 and charge 3 likewise renders superfluous a number of transport movements which are otherwise necessary—according to the prior art—for the execution of the rinsing operation.

The transfer of the barrel 2 to the next rinsing compartment and lowering of the barrel into the latter (about 9 sec.), the rinsing in the first compartment of a subsequent three-stage cascade (for about 60 sec.) and the raising of the barrel 2 out of the latter (3 sec.) are all omitted; these times would add up to approximately 72 sec.

If it is further assumed that a barrel installation—for example for acid galvanising—requires 7 stations for the surface treatment of the mass parts, then the passage time of the individual barrel units through the installation might be shortened, according to the invention, by about 500 sec.

The consistent substantial reduction of the otherwise necessary transport movements, the shortening of the passage times for the barrel units and the resultant reduction of the required cascade rinsings by one compartment in each case, i.e., in the case of the preceding example, a reduction of the barrel installation by 7 rinsing stations, constitute improvements by comparison with the prior art which are of exceptional technical and economic importance.

The space required for the erection of such compact installations is accordingly smaller, fewer transport movements result in a reduction of the required automatic transport system and the costs of production of the installation are reduced accordingly.

The economic advantages for operational practice that are attainable according to the invention are obvious; the consumption of chemicals for the different bath solutions and for the neutralization or decontamination of the rinsing water is drastically reduced and the rinsing water requirement diminishes largely proportionately to the percentage of the recovered quantities of electrolyte.

I claim:

1. An apparatus for direct recovery of residual quantities of an aqueous solution adhering to pourable mass parts following at least one of an electrolytic surface and chemical surface treatment on the parts, said apparatus comprising:

a perforated immersion barrel for receiving said mass parts to be charged in said barrel, and said barrel being supported on a movable carriage of a barrel installation, a compressed-air chamber for receiving said barrel and providing a compressed air source for causing a current of air to flow transversely through said chamber, and said compressed-air chamber essentially includes a horizontal, upwardly cylindrically convex upper half-shell fixed on said movable carriage and encompassing in a substantially air-tight manner the upper half of the immersion barrel when positioned within said chamber, and a pair of horizontal, lateral, lower, outwardly cylindrically convex quarter-shells for moving towards one another and which when so moved encompass the lower half of the immersion barrel in a substantially air-tight manner, the two quarter-shells having two lowermost long edges and leaving open a relatively narrow longitudinal slot between the two lowermost long edges through which said slot the current of air downwardly leaves the compressed-air chamber after passing transversely through the perforated immersion barrel and the charge of parts contained therein.

2. The apparatus according to claim 1, further comprising:

means for supplying the current of air from a compressed-air supply line to said compressed-air chamber and, means for simultaneously supplying water from a water supply line to an injection nozzle is, and said injection nozzle arranged to supply water to the compressed-air chamber.

3. The apparatus according to claim 1, comprising at least one low-pressure centrifugal fan, said at least one fan is positioned on the upper half-shell of the compressed-air chamber, said at least one fan for supplying air into said chamber.

4. The apparatus according to claim 1, comprising at least one injection nozzle, rigidly disposed on the upper half-shell of the compressed-air chamber, for directing water into the chamber.

5. The apparatus according to claim 1, wherein the upper half-shell of the compressed-air chamber has an apex and an open longitudinal slot positioned at said apex through which a supporting beam of the barrel together with a drive motor being mounted on the beam to form a barrel unit, said drive motor for rotating the barrel, so as to render possible the vertical upward and downward movement of the barrel.

6. The apparatus according to claim 5, wherein said apparatus comprising displaceable or pivotal sealing elements positioned on the barrel unit for closing said open longitudinal slot in an air-tight manner following positioning of the barrel in the compressed-air chamber.

7. The apparatus according to claim 5, wherein said apparatus comprising:

displaceable or pivotal sealing elements positioned on the upper half-shell for closing said open longitudinal slot in an air-tight manner following positioning of the barrel in the compressed-air chamber.

8. The apparatus according to claim 1, comprising: a driving mechanism for actuation of the two lower quarter-shells; and lever arms coupled to the quarter-shells together with operating elements disposed on the barrel to form a barrel unit for moving with respect to the compressed-air chamber.

9. The apparatus according to claim 1, wherein the long, open slot between the two lowermost edges of the quarter-shells has a width that subtends a center angle, relative to the longitudinal axis of the barrel when positioned in the compressed-air chamber and said center angle is equal to or less than 50°.

10. The apparatus according to claim 1, wherein said apparatus comprising:

at least one centrifugal fan being associated with the compressed-air chamber, said at least one fan for delivering an output volume of 1000 $m^3/h$ of air at a pressure of 0.3 bar for a barrel, said at least one fan having the approximate dimensions of an inside length of 950 mm and an inscribed circle diameter of 360 mm.

11. The apparatus according to claim 1, wherein said apparatus comprising:

injection nozzles to provide the pressure for the generation of a water jet sprayed and the provided pressure corresponds to the pressure of a water line in a range of 3 to 4 bar, and pressure reducing valves for reducing the pressure by 0.5 bar.

12. The apparatus according to claim 1, wherein the barrel has an array of longitudinal tumbling strips on the inside of the perforated immersion barrel.

* * * * *